United States Patent [19]

Nelson et al.

[11] Patent Number: 4,794,667

[45] Date of Patent: Jan. 3, 1989

[54] DETACHABLE AUXILIARY HANDLE

[76] Inventors: Stanley E. Nelson; Richard S. Nelson, both of Rte. 3, Box 136 K, Buffalo, Minn. 55313

[21] Appl. No.: 120,200

[22] Filed: Nov. 4, 1987

Related U.S. Application Data

[63] Continuation of Ser. No. 880,658, Jul. 1, 1986, abandoned, which is a continuation-in-part of Ser. No. 732,912, May 13, 1985, abandoned.

[51] Int. Cl.[4] ..... B25G 3/24

[52] U.S. Cl. ..... 16/114 R; 16/DIG. 25; 294/58

[58] Field of Search ..... 16/110 R, 114 R, 115, 16/253, DIG. 24, DIG. 25; 403/344; 294/57, 58

[56] References Cited

U.S. PATENT DOCUMENTS

| | | | |
|---|---|---|---|
| 61,859 | 2/1867 | Pease . | |
| 237,891 | 2/1881 | Musselman . | |
| 473,250 | 4/1892 | Carleton . | |
| 933,647 | 9/1909 | Hunt | 294/58 |
| 1,083,054 | 12/1913 | Brown . | |
| 1,151,012 | 8/1915 | Herringstad | 294/58 |
| 1,687,190 | 10/1928 | Wulff . | |
| 2,614,879 | 10/1952 | Citso . | |
| 2,651,806 | 9/1953 | Thompson | 16/253 |
| 3,466,076 | 9/1969 | Sholund . | |

*Primary Examiner*—Fred A. Silverberg
*Attorney, Agent, or Firm*—Steven E. Kahm

[57] ABSTRACT

The invention is a detachable auxiliary handle that may be attached to the shaft of a work implement such as a shovel, rake, hoe or other implement. The auxiliary handle may be placed at any point on the shaft to suit the user and will fit almost any size and shape of shaft. The auxiliary handle is composed of a handle and two brackets, one bracket attached to each side of the handle. The brackets have a vertical arm portion and a horizontal portion leading to a shaft engaging portion, which is vertical and has a curved shaft engaging section which is tightened around the shaft of the implement with bolts. Preferably the vertical arm portion is curved in the vertical plane to provide extra leverage and greater ease of use.

2 Claims, 4 Drawing Sheets

DETACHABLE AUXILIARY HANDLE

This is a continuation-in-part of application Ser. No. 06/880,658, filed Sept. 1, 1986, now abandoned, which is a continuation-in-part of application Ser. No. 06/732,912, filed May 13, 1985, now abandoned.

BACKGROUND OF THE INVENTION

This invention relates to auxiliary handles that are easily and adjustably attached to the shafts of shovels, rakes, hoes, and other implements.

An auxiliary handle attached to the shaft of an implement has many advantages for the user, including but not limited to the following:

It makes it easier to grasp the shaft of the implement, and can reduce blisters caused by the hand rubbing on the shaft.

It reduces the amount of bending over to grasp the shaft and is therefore easier on the back of the user.

It provides leverage for manipulating the implement with greater ease.

In the past many different designs of auxiliary handles have been offered, however each of the devices heretofore invented has either had flaws hampering its use or lacked certain features which the inventor considers important.

For example most of the patents examined disclose a rigid circular portion for attaching the auxiliary handle to the shaft of the implement, however due to the diameter of the rigid circular portion not all shaft diameters or shapes of shafts will fit the auxiliary handle.

Another problem with most other designs is that the arms of the handle do not flex to widen or narrow the shaft engaging portion so as to adjust to any size implement shaft.

Most of the prior auxiliary handles have a yoke portion which holds the handle in place and does not leave too much room for the user's hand and may be difficult to use if the user is wearing insulated mittens or gloves in cold weather for shoveling snow.

Most of the prior auxiliary handles don't provide much leverage for the user because the handle is so close to the shaft.

Finally the cost of manufacture is of vital importance for marketing of the auxiliary handle, and most prior auxiliary handles required special parts to be made, expensive tooling or both.

SUMMARY OF THE INVENTION

This invention provides an adjustable auxiliary handle for shovels, rakes, hoes and other implements. The handle may be attached to practically every size and shape of shaft used on an implement. The auxiliary handle's shaft engaging portion is composed of two opposing curved surfaces which can be tightened around very narrow or very large diameter shafts, or around shafts that are oval or oblong.

The auxiliary handle is composed of a handle having two brackets which flex along their length so that the shaft engaging portion may be compressed together for engaging smaller diameter implement shafts and or spread apart for engaging larger diameter shafts.

The curves on the shaft engaging portion have a special diamond shape to permit them to securely engage smaller shafts when the brackets are compressed together and for securely engaging larger diameter shafts when the brackets are spread apart.

A further object of this invention is to provide plenty of room for the user's hand. The invention has two widely separated brackets comprising a yoke running essentially from the implement's shaft to the handle. This allows plenty of room for the user's hand particularly if he is wearing gloves or mittens in conjunction with snow shoveling.

A further improvement is that the auxiliary handle can be made with curved brackets to provide extra leverage, and the brackets don't interfere with the user's hand at the handle as much.

The present invention is very inexpensive and simple to manufacture compared to the prior art. It requires only brackets made of two pieces of inexpensive strap steel, a handle and three bolts.

DETAILED DESCRIPTION OF THE INVENTION

Figure 1:
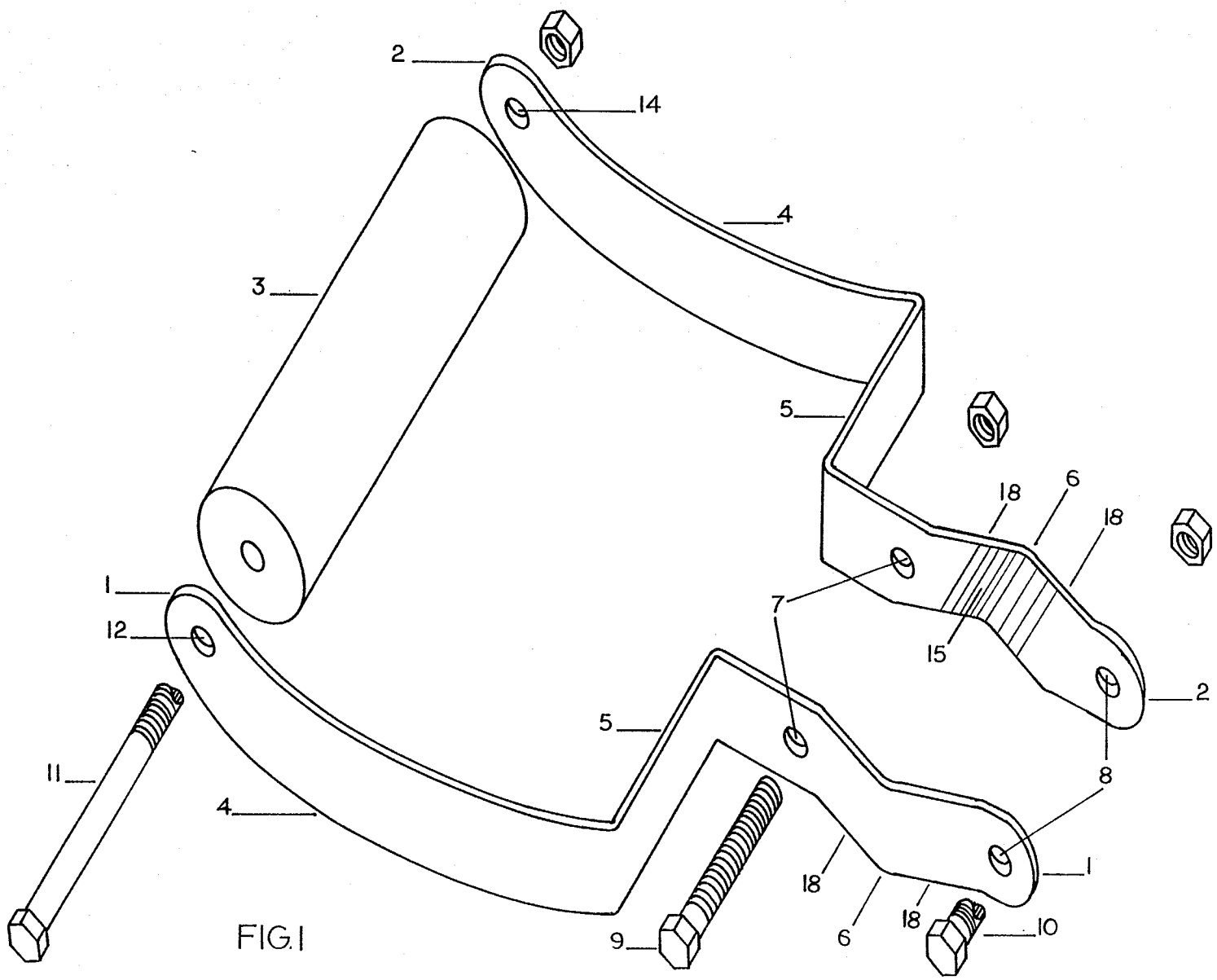
FIG. 1 shows an exploded perspective view of the auxiliary handle with a curved vertical arm.

Referring now to the drawings FIG. 1 shows an auxiliary handle composed of two pieces of strap steel or other material which is bent into right and left brackets 1 and 2 respectively, and a handle 3.

Figure 3:
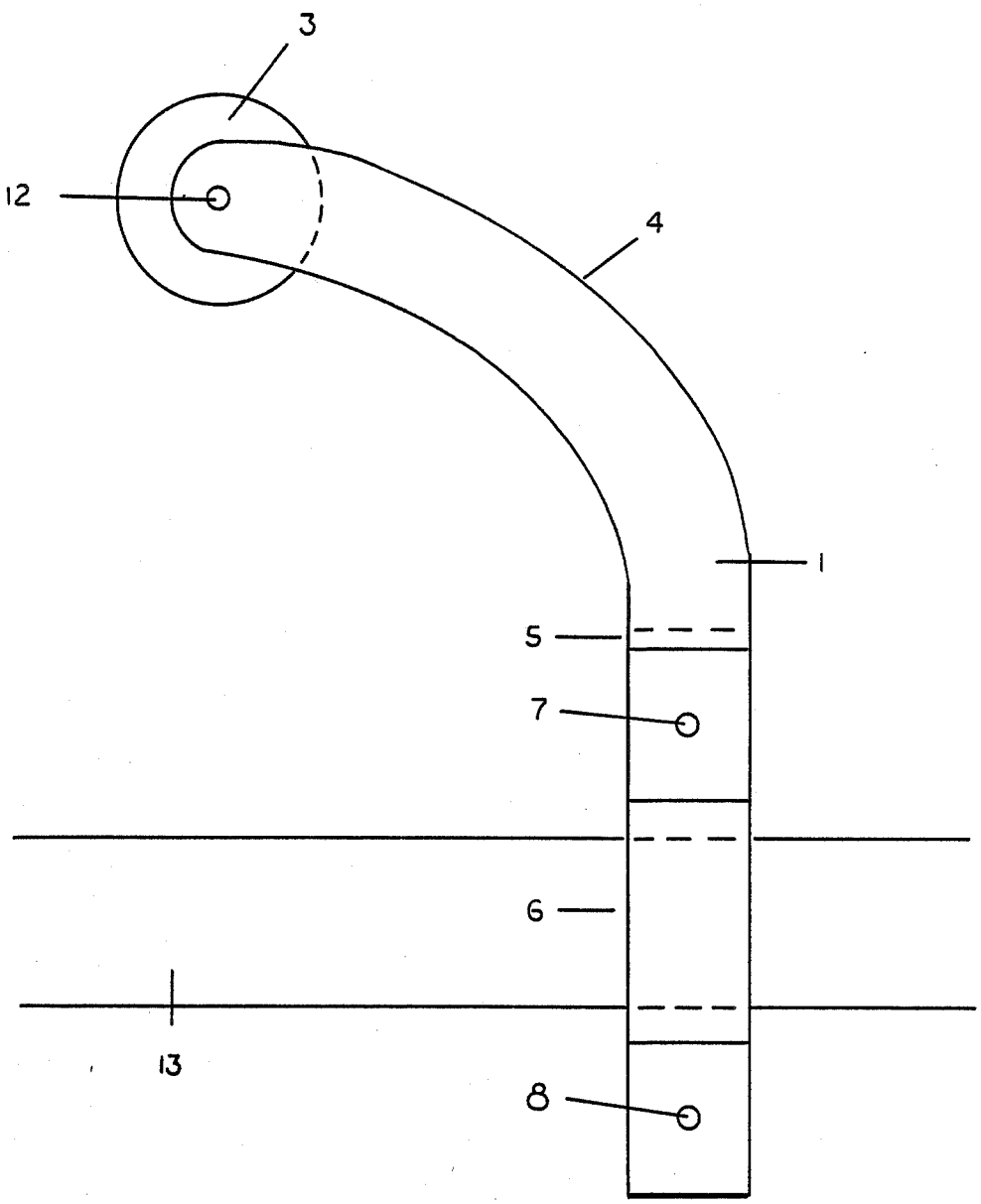
FIG. 3 shows a side view of the auxiliary handle with a curved vertical arm, attached to a shaft.
Figure 4:
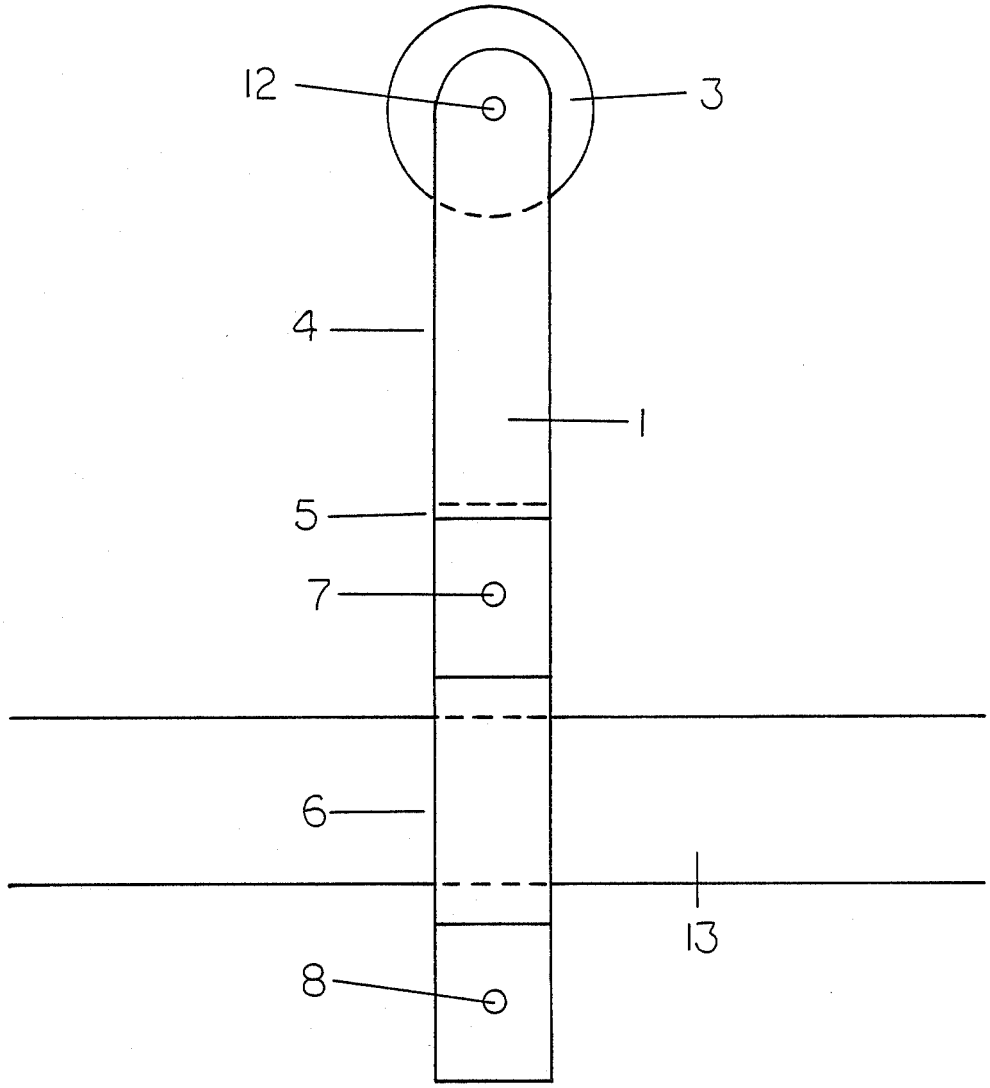
FIG. 4 shows a side view of the auxiliary handle with a straight vertical arm, attached to a shaft.

Brackets 1 and 2 have vertical arm portions 4, which are attached to each end of the handle 3, and extend downward from the handle. In one embodiment the arm portions 4, are curved as shown in FIGS. 1 and 3, and in another embodiment they are straight as shown in FIG. 4.

It is preferred to make the brackets 1 and 2, out of strap steel approximately 2 millimeters thick or some other resilient material that will flex so that the shaft engaging portion 6, can be compressed together or spread apart to accept small or large diameter implement shafts. Since the brackets will flex, the length of the bracket from the handle 3, to the shaft engaging portion 6, is used as a spring to adjust the gap between the opposing shaft engaging portions 6. It is important to select a flexible resilient material that will not easily fatigue and crack or break after repeated flexing.

It is preferred to have a curved arm portion 4, so that there is more leverage for easier manipulation of the implement and so the hand of the user around the handle is less encumbered by unwanted contact with the arm portions 4, which usually occurs below the handle.

There is a horizontal portion of the bracket 5, just below the arm portion 4, that runs to a point near the center of the handle. Each of the horizontal portions 5, are less than half the handles length so that the flat part of the shaft engaging portion 6, will be about three fourths of an inch apart before being compressed together or spread apart. The spacing is to allow for the average diameter of an implement shaft, which is about one inch, to fit in between the shaft engaging portions 6.

The horizontal portion 5, allows the arm portion 4, to be spaced as far apart as the handle's 3, length, which allows plenty of room for the user's hand around the handle.

The shaft engaging portion 6, is just below the horizontal portion 5.

Figure 2:
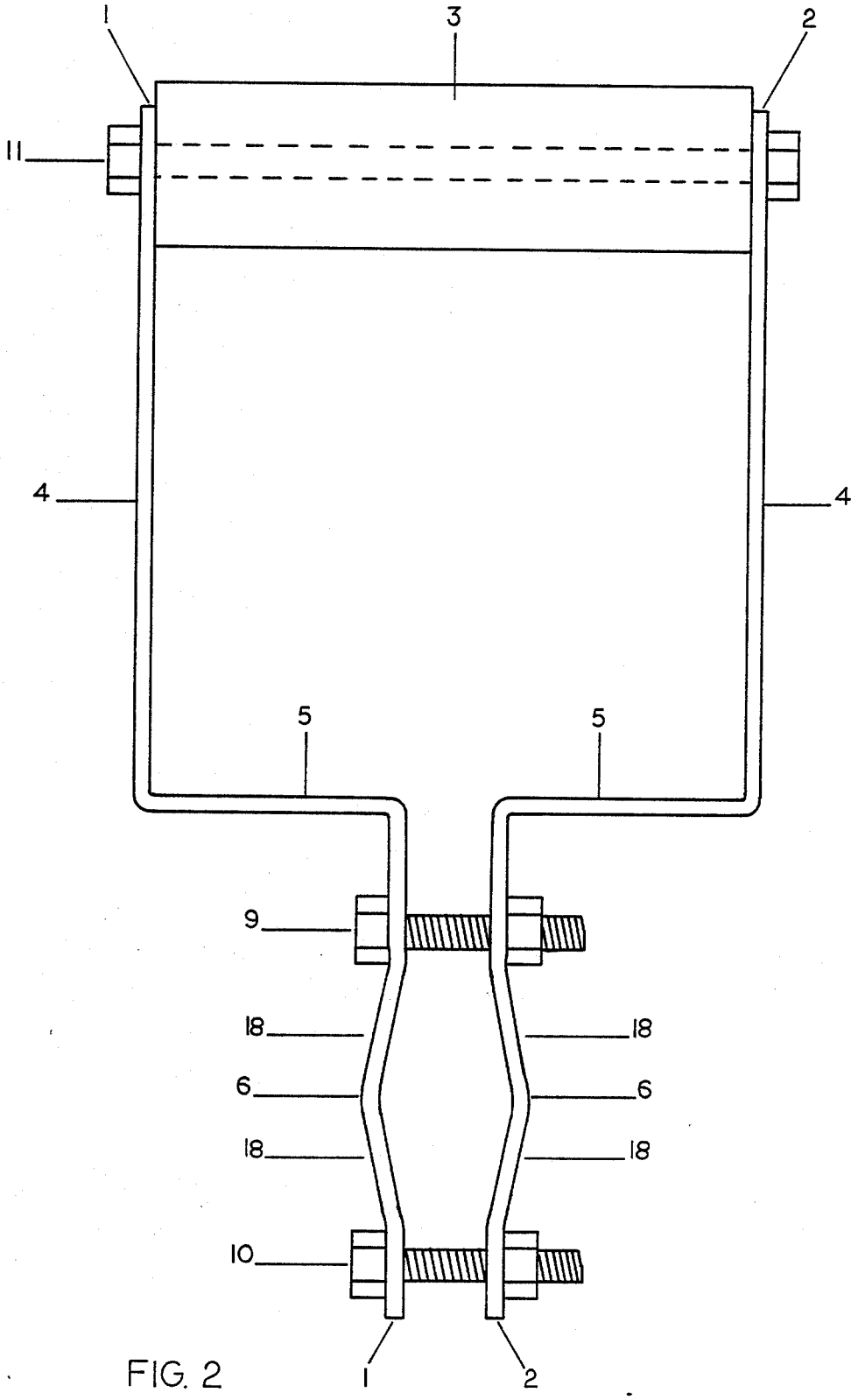
FIG. 2 shows a front view of the auxiliary handle.

The center section of the shaft engaging portion 6, is specially shaped for receiving any sized shaft on an implement. The shaft engaging part is preferably indented only approximately one fourth of an inch over approximately a one and one half inch length. There is preferably a small arc curve in the middle of the shaft engaging portion and a straight section 18, on either side of the curved section leading to a small angled curve adjoining the straight part of the shaft engaging portion 6. The curved shaft engaging portion 6, thus has a diamond shape when viewed from the side, as shown in FIG. 2. Thus the shaft engaging portion 6, will fit over both large and small diameter shafts and oblong shafts. The diamond shaped shaft engaging portion can be compressed down to about five eighths of an inch before the opposing sides of the shaft engaging portions touch each other, for engaging small diameter shafts. The diamond shaped shaft engaging portion 6, can also be spread apart to engage larger diameter shafts.

The small arced curve in the middle of the shaft engaging portion 6, allows the handle to be attached to a wide range of diameters of implement shafts.

The shaft engaging portion 6, may have ridges 15, (FIG. 1), or some other means of increasing the friction on the implements shaft, on its inside surface for better gripping of the implements's shaft.

The bracket has bolt holes 7 and 8, just above and below the curved section for receiving bolts 9 and 10, which tighten the shaft engaging portion around a shaft 13.

The handle 3, can be secured to the brackets 1 and 2 by placing a bolt 11, through bolt holes 12, 14 in brackets 1 and 2 and through a hole in the center of handle 3.

That which is claimed is:

1. A detachable auxiliary handle assembly for attachment to an implement shaft comprising:

a handle, having a length and a center and having opposing ends, two flexible brackets of a rigid and resilient consistency, one attached to each end of the handle, each bracket consists of a vertical arm portion, being disposed vertically, perpendicular to the handle, extending downward from the handle, and running to a horizontal portion, which is disposed perpendicular to the vertical arm portion, running inward toward the center of the handle, each said horizontal portion having a length less than one half the length of the said handle and running to a flat vertical portion having a length and a center, disposed perpendicular to said horizontal portion, extending downward and having a shaft engaging portion in the center of its length, said shaft engaging portion having a curve in the center of its length with a straight section on either side thereof leading back to the vertical portion, and having holes above and below said shaft engaging portion, a pair of bolts and nuts for insertion through said holes to tighten the curved shaft engaging portion around an implement shaft, the brackets being composed of resilient, flexible, thin strips of strap steel, approximately 2 millimeters thick, which will bend to allow the shaft engaging portion to be spread apart or compressed together to fit various sized implement shafts said handle being cylindrical and having a central axis and a hole through the handle along said central axis, the brackets having holes therein so that said handle is attached to the brackets by a bolt passing through the holes, the curved shaft engaging portion having ridges thereon for gripping the implement shaft more securely, the length of the brackets from the handle to the shaft engaging portion is used as a spring to adjust the gap between the shaft engaging portions, the flat vertical portions being about three fourths of an inch apart in its initial unattached condition, the shaft engaging portion being indented approximately one fourth of an inch over approximately a one and one half inch length, the shaft engaging portions having a diamond shape in their assembled state, the diamond shaped shaft engaging portions being able to be compressed down to about five eighths of an inch before opposing said flat vertical portions touch each other.

2. A detachable auxiliary handle as in claim 1 where the vertical arm portion is curved.

* * * * *